US006446622B1

(12) United States Patent
Home

(10) Patent No.: US 6,446,622 B1
(45) Date of Patent: Sep. 10, 2002

(54) STOVE IGNITION STRUCTURE

(75) Inventor: William Home, Taipei (TW)

(73) Assignee: Grand Hall Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/690,986

(22) Filed: Oct. 18, 2000

(51) Int. Cl.[7] ..... F23Q 3/00; F23Q 2/28
(52) U.S. Cl. ..... 126/39 E; 431/254; 431/256
(58) Field of Search ..... 431/18, 280, 256, 431/254; 126/39 E, 39 J, 39 BA

(56) References Cited

U.S. PATENT DOCUMENTS 3,477,797 A * 11/1969 Zielinski et al.
3,969,875 A * 7/1976 Nofel
4,523,083 A * 6/1985 Hamilton
4,872,435 A * 10/1989 Ueyama et al.
5,228,469 A * 7/1993 Otten et al.
5,448,029 A * 9/1995 Leorat et al.
6,112,714 A * 9/2000 Brister

FOREIGN PATENT DOCUMENTS

JP 60-228821 * 11/1985 ..... 431/256

* cited by examiner

*Primary Examiner*—Carl D. Price
(74) *Attorney, Agent, or Firm*—Rosenberg, Klein & Lee

(57) ABSTRACT

An improved stove ignition structure includes an ignition knob, a jump spark power source, a magnetic switch, an electric spark generator, and a lead wire for circuit connection. The ignition knob is provided on a control panel of a stove. The center of the knob face near the control panel is inserted and fixed in a valve shaft extending from a gas valve in the stove. A magnetic is disposed at the periphery of the knob face at a suitable position. The magnetic switch is provided on the inner wall of the stove corresponding to the ignition knob such that the magnet reaches a determined ignition position. Two electrical contacts of the magnetic switch are connected to the jump spark power source of the stove. A voltage output end of the jump spark power source is connected via the lead wire to the spark generator at the bottom of a stove disk. The magnetic force is utilized to control the magnetic switch to connect the jump spark power source so as to send a jump spark voltage to the spark generator to generate sparks for igniting gas.

2 Claims, 3 Drawing Sheets

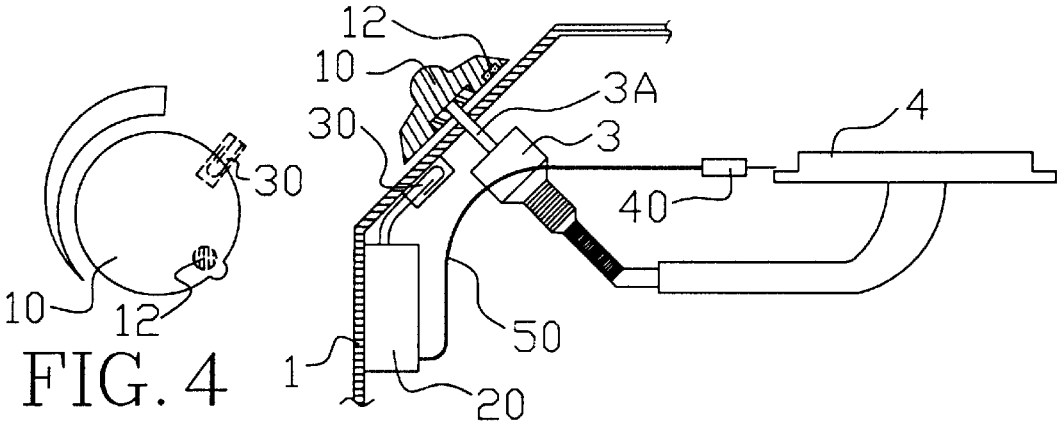
FIG. 4
FIG. 5
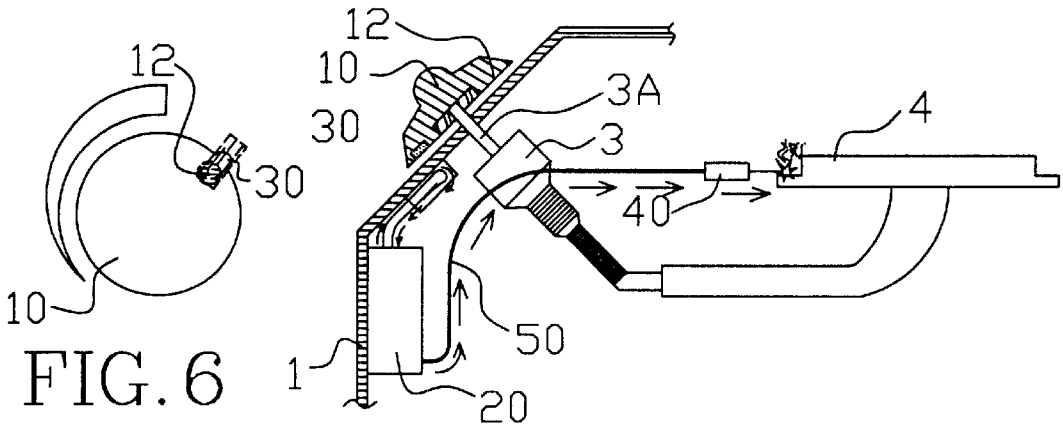
FIG. 6
FIG. 7

STOVE IGNITION STRUCTURE

BACKGROUND OF THE INVENTION (a) Field of the Invention

The present invention relates to an improved stove ignition structure, more particularly to an ignition structure that utilizes an ignition knob to control ignition and that is simple in construction.

(b) Description of the Prior Art

Gas stoves are common appliances used in cooking food. Conventional stoves are generally equipped with an ignition knob which is turnable to control ignition. The conventional ignition structure includes many structural elements. When the ignition knob is turned, the structural elements collide to generate sparks that ignite the gas at a stove disk. However, as such an ignition structure includes many mechanical parts, the rate of their being damaged is high. Aside from having a complicated construction, the conventional ignition structure has the following additional drawbacks:

1. When the ignition knob is turned, the spark generating elements collide, which creates noise and vibration and result in loosening or damage of the elements.
2. As the parts linked up with the ignition knob are in frictional contact, the friction and resistance posed by the linked up parts obstruct smooth turning of the ignition knob. After prolonged use, due to wear of the mechanical parts, gaps therebetween are widened, which affect the ignition effect.
3. When the stove is not in use, a certain collision stroke has to be left between the two parts for generating sparks. As such, the two end strike faces are susceptible to dust, oil stains, etc., which weakens the capacity of the strike faces to generate spark by collision, and results in insufficient sparks or failed ignition.

SUMMARY OF THE INVENTION

The object of the present invention is to provide an improved stove ignition structure which is simple in construction to facilitate stock inventory, and which improves the complicated mechanical type ignition structure of the prior art. According to this object, the improved stove ignition structure of this invention includes an ignition knob, a jump spark power source, a magnetic switch, an electric spark generator, and a lead wire for circuit connection. The ignition knob is provided on a control panel of a stove. The center of the knob face near the control panel is inserted and fixed in a valve shaft extending from a gas valve in the stove. A magnetic is disposed at the periphery of the knob face at a suitable position. The magnetic switch is provided on the inner wall of the stove corresponding to the ignition knob such that the magnet reaches a determined ignition position. Two electrical contacts of the magnetic switch are connected to the jump spark power source of the stove. A voltage output end of the jump spark power source is connected via the lead wire to the spark generator at the bottom of a stove disk. The magnetic force is utilized to control the magnetic switch to connect the jump spark power source so as to send a jump spark voltage to the spark generator to generate sparks for igniting gas.

Another object of the present invention is to provide an improved stove ignition structure that utilizes a jump spark power source capable of supplying a sufficient jump spark voltage to serve as a spark generator source, which does not generate noise or vibration to damage parts of the structure.

Furthermore, since the improved stove ignition structure of this invention utilizes a non-contact type magnetic force as a source for actuating the circuit to generate sparks, the force of resistance or attraction being slight, the turning of the ignition knob will not be subjected to magnetic resistance. Moreover, as there is not frictional contact resistance, turning of the ignition knob is very smooth. Wear of ignition parts is also reduced to ensure ignition effect.

In addition, since the improved stove ignition structure of this invention does not require collision of mechanical parts to generate sparks, there is no need for a collision stroke. As such, there are no gaps between the relevant parts to admit dust or oil stain which may affect ignition.

BRIEF DESCRIPTION OF THE DRAWINGS

The foregoing and other features and advantages of the present invention will be more clearly understood from the following detailed description and the accompanying drawings, in which.

FIG. 4 illustrates the position of the ignition knob;

FIG. 5 illustrates the ignition structure;

FIG. 6 illustrates the position of the ignition knob; and

FIG. 7 illustrates the ignition structure.

DETAILED DESCRIPTION OF THE PREFERRED EMBODIMENT

Figure 1:
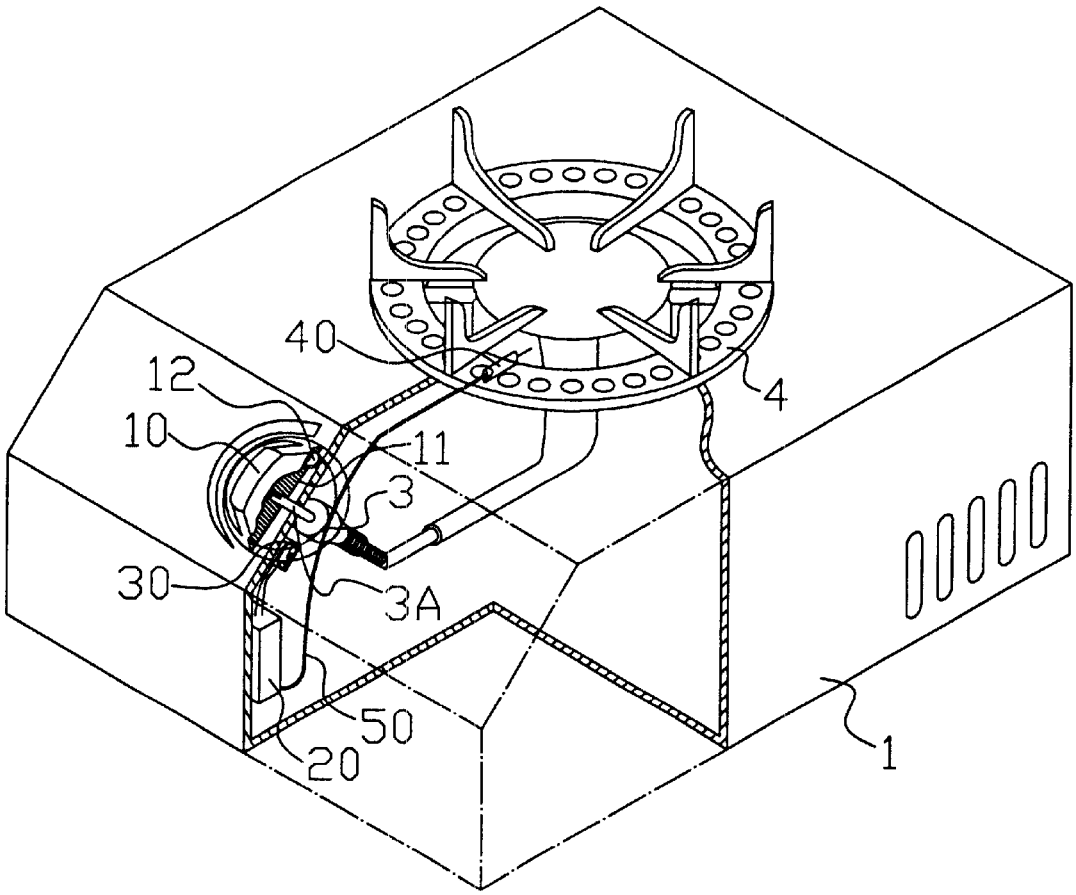
FIG. 1 is a perspective sectional view of the present invention.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings: in which a preferred structural embodiment incorporating the principles of the present invention is shown by way of illustrative example.

Figure 2:
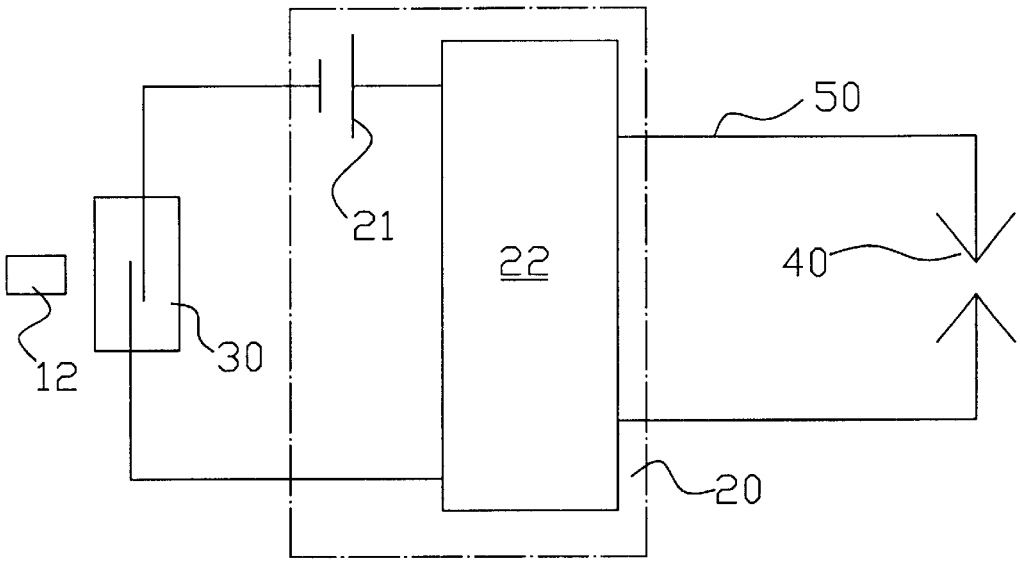
FIG. 2 is a circuit diagram of the present invention.

FIG. 1 shows a perspective sectional view of an improved stove ignition structure of the present invention. With reference to FIG. 2, which shows an ignition circuit, an improvement provided by the present invention includes an ignition knob 10, a jump spark power source 20, a magnetic switch 30, an electric spark generator 40, and a lead wire 50 for circuit connection. The ignition knob 10 is provided on a control panel 2 of a stove. The center of the knob face near the control panel 2 is inserted and fixed in a valve shaft 3A extending from a gas valve 3 in the stove. A magnet 12 is disposed in a suitable position at the periphery of the knob face 11. The magnetic switch 30 is provided on the inner wall of the stove 1 opposite to the ignition knob 10 such that the magnet 12 reaches a determined ignition position. The two contact ends of the magnetic switch 30 are connected to the jump spark power source 20 in the stove. The jump spark power source 20 may, as shown in FIG. 2, include a battery unit 21 connected to a boost circuit 22. The magnetic switch 30 controls connection of the low-voltage portion of the battery unit 21, while the voltage output end of the jump spark power source 20 is connected via lead wire 50 to the spark generator 40 near the bottom of a stove disk 4.

Figure 3:
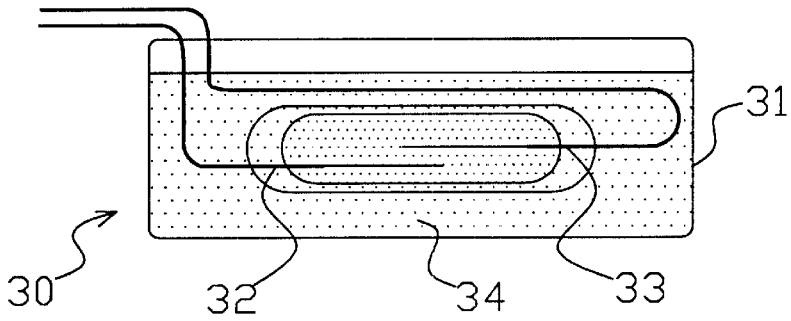
FIG. 3 is a schematic view of the magnetic switch.

As shown in FIG. 3, the structure of the magnetic switch 30 generally includes an elongated enclosed glass tube 31 enclosing a pair of oppositely facing spring plates 32, 33, and inert gas 34. The parts of the spring plates 32, 33 that extend out of the glass tube 31 form contacts, while opposite plate ends of the spring plates 32, 33 inside the glass tube form aligned magnetic contacts that do not contact: in normal conditions. When the magnet 12 is spaced a distance of several mm away from the magnetic switch 30 without contact, the two spring plates 32, 33 are subjected to the magnetic force of the magnet 12, thereby achieving contact and making electrical connection. After the magnet 12 is away from the magnetic switch 30, the switch 30 will return to a disconnected state. By means of using the magnetic force to act upon the magnetic switch from several mm away, even if the magnet 12 and the magnetic switch are spaced slightly apart by the thin wall of the control panel 2 of the stove, the magnetic control effect will not be affected.

According to the above-described construction, when the stove disk 4 is not in a state of ignition, referring to FIG. 4, the magnet 12 on the ignition knob 10 is spaced apart from the magnetic switch 30 in the stove, hence it will not affect connection of the magnetic switch 30, and the entire ignition structure is as that shown in FIG. 5. The magnetic switch 30 cuts off the circuit of the jump spark power source 20 so that the jump spark power source 20 will not have a jump spark voltage transferred to the spark generator 40, and sparks will not be generated at the stove disk 4. When it is desired to ignite the stove disk 4, referring to FIG. 6, it is only necessary to turn the ignition switch 10 so that the magnet 12 and the magnetic switch 30 in the stove instantly overlap, the magnetic force generated by the magnet will cause the magnetic switch 30 to be instantly connected electrically. During the process of turning, the gas valve 3 of the stove is also turned on to permit flow of gas to the stove disk 4 so that the entire ignition structure is as that shown in FIG. 7. The magnetic switch 30 connects the circuit of the jump spark power source 20, so that the jump spark power source 20 has a spark voltage sent to the spark generator 40 to cause generation of sparks by the spark generator 40, thereby ignition the gas at the stove disk 4. When the ignition knob 10 is turned past the position of the magnetic switch 30, the magnetic switch 30 will return to a cut-off state. Under the conditions that the gas valve 3 remains open, the stove disk 4 achieves a full burning state after ignition.

From the aforesaid, it can be seen that the improved stove ignition structure according to the present invention can achieve the function of magnetic control of ignition via an ignition knob with a simpler construction, but without the drawbacks associated with the prior art.

It will be understood that each of the elements described above, or two or more together may also find a useful application in other types of methods differing from the type described above.

While certain novel features of this invention have been shown and described and are pointed out in the annexed claim, it is not intended to be limited to the detail's above, since it will be understood that various omissions, modifications, substitutions and changes in the forms and details of the device illustrated and in its operation can be made by those skilled in the art without departing in any way from the spirit of the present invention.

I claim:

1. A stove with a spark ignition system comprising:

a stove body having a control panel;

a gas burner mounted on said stove body;

a gas valve mounted in said stove body and having an inlet coupled to a gas supply and an outlet coupled to said gas burner, said gas valve having a rotatable operating shaft extending from a rear side of said control panel to a front side thereof through a corresponding opening formed in said control panel;

a knob having an upper side adapted for manual rotation thereof and a bottom side coupled to said operating shaft for rotating said operating shaft in correspondence with manual rotation of said knob, said knob having a magnet mounted adjacent a peripheral portion of said bottom side thereof;

a magnetically operated switch mounted to said rear side of said control panel in proximity of said operating shaft, said magnetically operated switch having a pair of normally open contacts being closed responsive to said magnet being rotated to a predetermined angular extent by rotation of said knob, said knob rotation operating said gas valve to supply gas to said gas burner;

a jump spark power source coupled to said contacts of said magnetically operated switch for generating a sparking voltage responsive to said closure of said contacts; and, a spark generator mounted adjacent said gas burner and electrically coupled to said jump spark power source by a lead wire for output of said sparking voltage to ignite the gas from the gas burner.

2. The stove with a spark ignition system as recited in claim 1, wherein said jump spark power source includes a battery unit and a boost circuit having an input coupled to said battery unit through said contacts of said magnetically operated switch and an output coupled to said lead wire.

* * * * *